US007946756B2

(12) United States Patent
Courvoisier et al.

(10) Patent No.: US 7,946,756 B2
(45) Date of Patent: May 24, 2011

(54) SHOCK ABSORBER FOR THE OSCILLATING WEIGHT OF A TIMEPIECE

(75) Inventors: Raphaël Courvoisier, Montmollin (CH); Alphonse Bron, Bassecourt (CH)

(73) Assignee: Montres Jaquet Droz SA, La Chaux-de-Fonds (CH)

( * ) Notice: Subject to any disclaimer, the term of this patent is extended or adjusted under 35 U.S.C. 154(b) by 80 days.

(21) Appl. No.: 12/424,421

(22) Filed: Apr. 15, 2009

(65) Prior Publication Data

US 2009/0257322 A1 Oct. 15, 2009

(30) Foreign Application Priority Data

Apr. 15, 2008 (EP) ..... 08154521

(51) Int. Cl.
*G04B 5/10* (2006.01)

(52) U.S. Cl. ..... 368/152; 368/203; 368/208

(58) Field of Classification Search ..... 368/148, 368/150, 207–208, 209–210, 145–147, 149, 368/151–152, 203, 206; 310/36
See application file for complete search history.

(56) References Cited

U.S. PATENT DOCUMENTS

| | | | | |
|---|---|---|---|---|
| 1,981,297 | A * | 11/1934 | Aegler | 368/208 |
| 2,399,131 | A * | 4/1946 | Matter | 368/208 |
| 3,006,138 | A * | 10/1961 | Fiechter | 368/208 |
| 5,043,956 | A * | 8/1991 | Tsukada et al. | 368/255 |
| 6,441,516 | B1 * | 8/2002 | Kaelin et al. | 310/36 |
| 7,170,826 | B2 * | 1/2007 | Furukawa et al. | 368/80 |
| 7,217,030 | B2 * | 5/2007 | Papi | 368/150 |
| 7,547,136 | B2 * | 6/2009 | Bravo et al. | 368/152 |

FOREIGN PATENT DOCUMENTS

| | | | |
|---|---|---|---|
| CH | 279 001 | A | 11/1951 |
| CH | 331 275 | A | 7/1958 |
| CH | 371 993 | A | 9/1963 |
| CH | 943 166 | D | 2/1968 |
| CH | 1 828 666 | D | 4/1969 |
| CH | 478 426 | A | 5/1969 |
| DE | 16 28 890 | U | 10/1951 |
| FR | 1 056 443 | A | 2/1954 |

OTHER PUBLICATIONS

European Search Report issued in corresponding application No. EP 08 15 4521, completed Jan. 7, 2009.

* cited by examiner

*Primary Examiner* — Sean Kayes
(74) *Attorney, Agent, or Firm* — Griffin & Szipl, P.C.

(57) ABSTRACT

The oscillating weight (2) is for automatically winding a timepiece movement; it pivots off-center relative to the center of the movement and is made of a single heavy material. The weight (2) is carried by a shock absorber (1) that takes the form of a plate (4), one end of which is secured to the weight and the other end of which is secured to a tube (5) arranged to rotate about an arbour (6) forming the axis of rotation of the weight.

4 Claims, 3 Drawing Sheets

SHOCK ABSORBER FOR THE OSCILLATING WEIGHT OF A TIMEPIECE

This application claims priority from European Patent Application No. 08154521.2, filed Apr. 15, 2008, the entire disclosure of which is incorporated herein by reference.

FIELD OF THE INVENTION

The present invention relates to an oscillating weight for the automatic winding mechanism of a timepiece movement, the weight pivoting off-centre relative to the centre of the movement and being made of a single heavy material.

BACKGROUND OF THE INVENTION

For a conventional, automatically wound watch, winding is achieved by the rotation of an oscillating weight whose radius is approximately equal to that of the movement and which pivots at the centre of and above said movement. In such case, the oscillating weight is normally formed of two distinct parts: the weight support and the heavy sector. The weight support carries the heavy sector on the periphery thereof and, at the centre thereof pivots on an arbour that forms the suspension of the entire oscillating weight. This support is generally made of brass or German silver and is deliberately made to be flexible to avoid damaging the oscillating weight suspension in the event of a shock. Here the weight support plays the part of a shock absorber.

One method of making the weight support flexible is disclosed in CH Patent No. 279 001. Here the heavy sector is carried by at least two resilient arms, which pivot on the same point of the frame, so that any axial shocks to the weight are absorbed by the resilience of the arms.

The heavy sector of a conventional large radius system is the external part of the oscillating weight and it is integral with the weight support to which it is screwed, riveted or crimped. It is formed of a sintered alloy or of precious metal with a large volumic weight.

When there is a low intensity shock, the resilience of the weight support is sufficient to protect the system from the impact. In the event of a high intensity shock, the movement of the oscillating weight is limited by the heavy sector pressing on the plate in one direction and on the back cover of the case in the other direction. The weight support, which is often decorated, is thus not liable to be scratched.

It has, however, already been proposed to limit the shake of the weight by stop members that are fitted in the oscillating weight and have rounded, polished parts, which project relative to the surface of said weight, so that, in the event of hard shocks, the weight does not touch the back cover of the case or the top of the plate. This embodiment is described in CH Patent No. 331 275.

SUMMARY OF THE INVENTION

Since the present invention concerns an oscillating weight that is off-centre relative to the centre of the movement, as disclosed, for example, in CH Patent Application No. 9,431/66, the solutions described for overcoming the detrimental effects of shocks applied to the timepiece are not suitable, since the radius of the oscillating weight is greatly reduced relative to that of a conventional oscillating weight to form what is called at micro-rotor. This micro-rotor is integrated in the movement and consequently does not hang over said movement, which in most cases leads to a reduction in the thickness of the timepiece.

Given that the moment of inertia of an oscillating weight depends upon its radius, its thickness and the material of which it is made, any loss generated by the reduction in radius observed across the micro-rotor has to be compensated for by an increase in thickness. Consequently, the micro-rotor will very thick and made in a single piece of a single heavy material, thereby doing away with the resilient weight support mentioned above. As the system no longer has the required resilience, the suspension around which the micro-rotor is hinged sustains the entire stress caused by a shock applied to the oscillating weight and is liable to be damaged.

Part of the shock in question could be compensated for by increasing the axial play of the rotor on its shaft, but the surface of the rotor opposite the back cover of the timepiece could then come into contact with the back cover and be damaged, as could any decoration that may be affixed thereto.

In order to overcome the aforecited drawbacks, in addition to satisfying the preliminary description given in the first paragraph of this description, the present invention is characterized in that the oscillating weight is carried by a shock absorber that takes the form of a plate, one end of which is secured to the weight, and the other end of which is secured to a tube, which is arranged to rotate around an arbour forming the rotational axis of said weight.

BRIEF DESCRIPTION OF THE DRAWINGS

The invention will now be explained in detail below with reference both to the functional drawings, and to drawings that illustrate a particular embodiment. The embodiment is given by way of non-limiting example and in the drawings.

DETAILED DESCRIPTION OF ILLUSTRATIVE EMBODIMENTS

Figure 1:
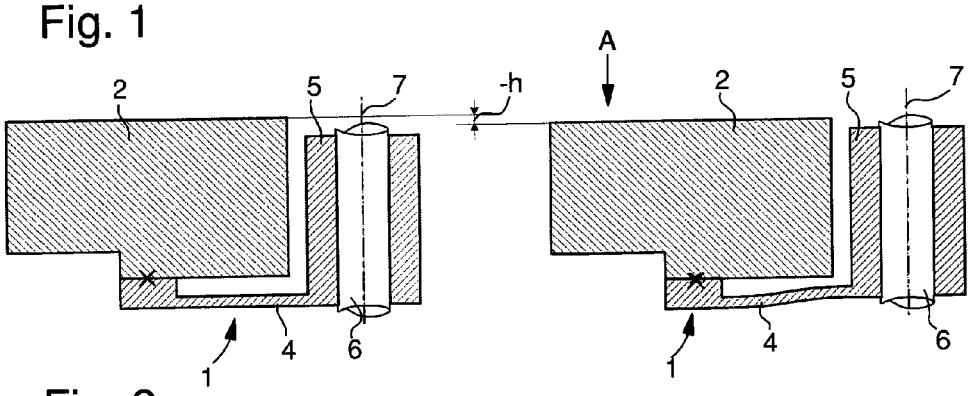
FIG. 1 is schematic, simplified cross-section showing the shock absorber according to the invention and the operation thereof when an axial shock is applied to the oscillating weight in one direction, illustrated by arrow A.
Figure 2:
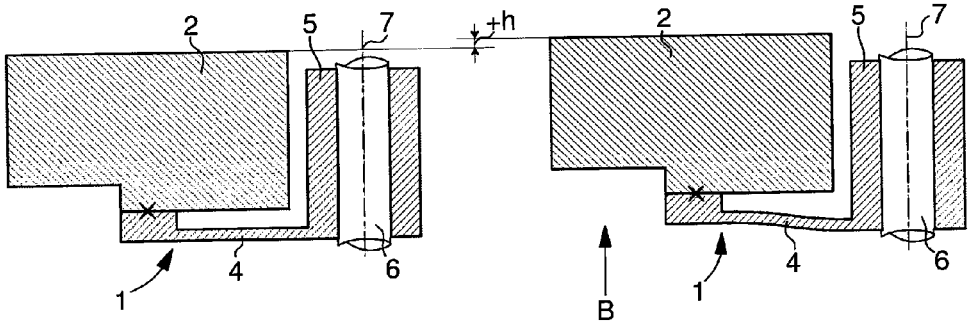
FIG. 2 is a schematic, simplified cross-section showing the shock absorber according to the invention and the operation thereof when an axial shock is applied to the oscillating weight in one direction, illustrated by arrow B.

FIGS. 1 and 2 are simplified cross-sections showing the principle of the invention. They show an oscillating weight 2 for automatically winding a timepiece movement 3, which is briefly outlined in FIG. 5. The weight 2 pivots off-centre relative to the centre of the movement, is integrated therein and is made of a single heavy material. As FIGS. 1 and 2 show clearly, and in accordance with an important feature of the invention, weight 2 is carried by a shock absorber 1, which takes the form of a plate 4, one end of which is secured to the plate (at the place marked by a X) and the other end of which is fixed to or integral with a tube 5, which is arranged to rotate around an arbour 6 forming the axis 7 of rotation of said weight.

Thus, any shock is mostly absorbed by shock absorber 1, which thus maintains the integrity of arbour 6 around which weight 2 rotates. The weight suspension no longer sustains the entire stress caused by the shock and is no longer liable to be damaged.

The left part of FIG. 1 shows oscillating weight 2 in its normal situation, i.e. when the timepiece is not affected by any shock. The right part of FIG. 1 shows the situation of oscillating weight 2 when the timepiece sustains an axially directed shock in the direction of arrow A. Weight 2 sinks by a distance –h relative to its normal position, causing plate 4 to bend and to play its parts as shock absorber 1 as shown in FIG. 1.

The left part of FIG. 2 shows the same oscillating weight 2 in a normal situation, with the timepiece unaffected by any shock. The right part of FIG. 2 shows the situation of weight 2 when the timepiece sustains an axially directed shock in the direction of arrow B, opposite to the direction of arrow A. Weight 2 is lifted up by a distance +h relative to its normal position, causing plate 4 to bend and again play its part as shock absorber 1, as shown in FIG. 2.

Figure 6:
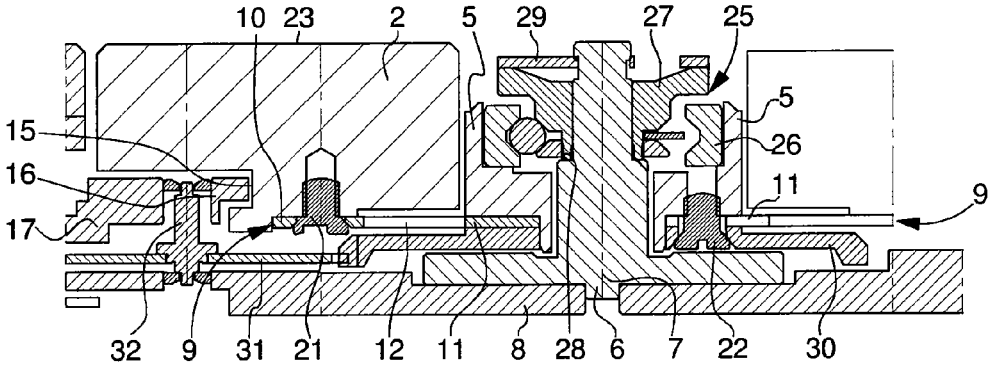
FIG. 6 is a large-scale cross-section along the line VI-VI of FIG. 5.

In both cases, it will be noted that tube 5 does not undergo any axial movement during shocks, since it is retained by design and as will be seen with reference to FIG. 6.

As will also be seen in FIG. 6, plate 4, acting as shock absorber 1, is preferably arranged between oscillating weight 2 and plate 8 of movement 3. This arrangement means that surface 23 of weight 2, which is opposite the surface to which plate 4 is fixed, is directly on the back cover of the timepiece. This surface 23 may be provided with a decoration, which can be made visible if the back cover is a sapphire glass, for example. If weight 2 is not provided with stop means for limiting its axial shake in the event of a shock, the decorated surface can come into contact with the back cover and thus be damaged.

Figure 3:
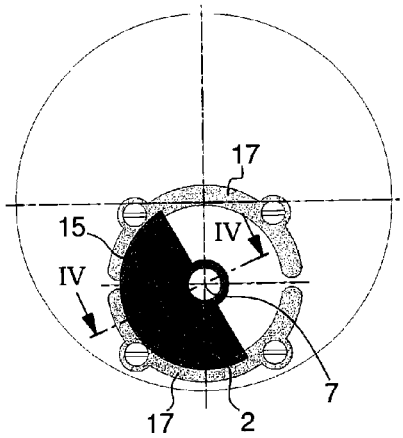
FIG. 3 is a schematic, simplified plan view of the oscillating weight fitted with the shock absorber according to the invention, said weight having stop means for limiting its shake in the event of any shock.
Figure 4:
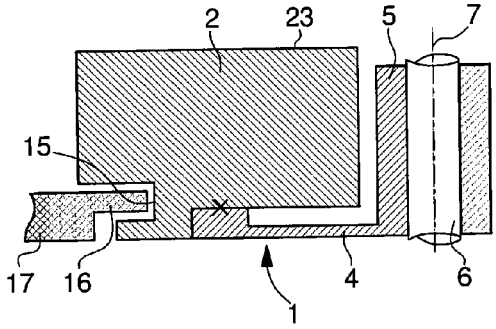
FIG. 4 is a cross-section along the line IV-IV of FIG. 3.

A possible embodiment for limiting the shake concerned is shown in FIGS. 3 and 4, which are simplified diagrams of a principle, taken by way of example. FIG. 3 is a plan view of this embodiment and FIG. 4 is an enlarged cross-section along the line IV-IV of FIG. 3. In these Figures, the stop means consist of a groove 15, made in oscillating weight 3. A retaining tongue 16, which may form the end of a banking bridge 17, penetrates this groove 15 with some play, as is clear in FIG. 6. The plays are calculated such that weight 2 never touches the back cover or the timepiece plate in the event of a shock.

Figure 5:
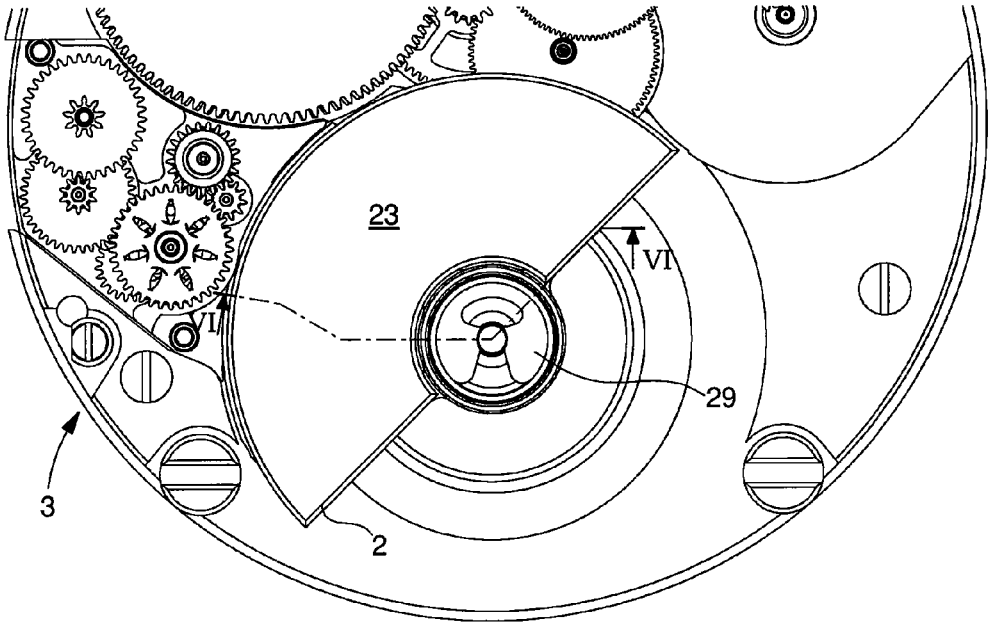
FIG. 5 is a plan view of a particular embodiment of the invention showing one part of the timepiece in which the oscillating weight and its shock absorber are integrated.
Figure 7:
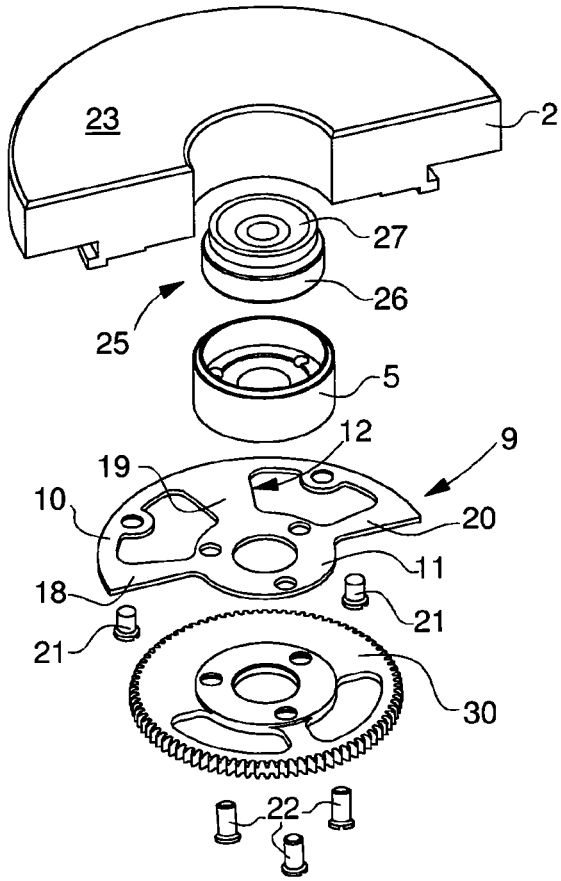
FIG. 7 is an exploded perspective view of the oscillating weight and shock absorber shown in FIG. 5.

FIG. 5 is a plan view and FIG. 6 is an enlarged cross-section along the line VI-VI of FIG. 5, of a particular practical embodiment of the present invention. FIG. 5 is a partial view, on the back cover side of the timepiece, which shows oscillating weight 2 integrated in movement 3. Surface 23 of weight 2 may be provided with a decoration and appear through a transparent back cover. FIG. 7 is an exploded perspective view of the mechanism forming the subject of the present invention and aids comprehension of the respective view and cross-section of FIGS. 5 and 6.

In this particular embodiment, plate 4, which plays the part of shock absorber 1 and is defined above, has the shape of an approximately semi-circular sector 9. This sector 9 is secured, in the peripheral zone thereof, to oscillating weight 2 and in the central zone 11 thereof, to tube 5. The intermediate zone 12 situated between said peripheral and central zones has a resilient middle that can bend in the event of any shock applied to oscillating weight 2.

One method of making intermediate zone 12 of sector 9 resilient is to provide spaces that leave arms connecting central zone 11 to peripheral zone 10, as is explained clearly in the aforecited CH Patent No 279 001. If the thickness of sector 9 is sufficiently thin, the arms will have the desired flexibility.

Figure 8:
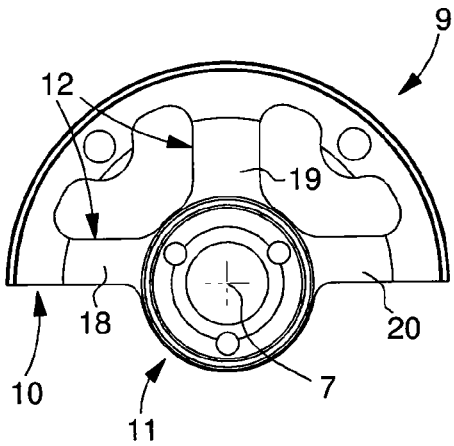
FIG. 8 is a plan view of an embodiment of the shock absorber shown in FIG. 7.

FIG. 8 is a plan view of one embodiment of sector 9, shown in perspective in FIG. 7. It is clear that intermediate zone 12 includes three resilient arms 18, 19 and 20 that start in peripheral zone 10 and are directed towards central zone 11, which surrounds the rotational axis 7 of oscillating weight 2.

Figure 9:
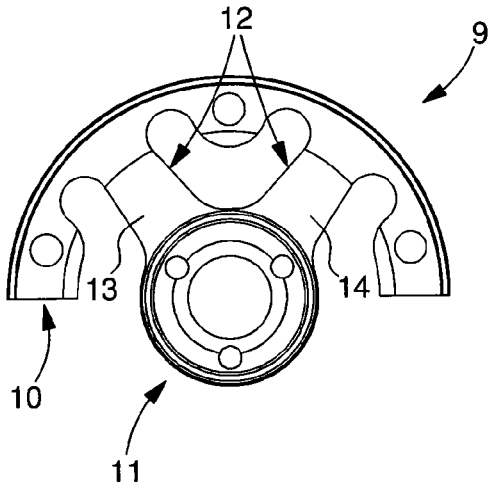
FIG. 9 is a plan view of another embodiment of the shock absorber.

FIG. 9 is a plan view of another embodiment of sector 9, which forms the shock absorber of the present invention. Here, intermediate zone 12 has only two resilient arms 13 and 14 connecting peripheral zone 10 and central zone 11 of sector 9.

To finish this description, we will return to the cross-section of FIG. 6, which we will associate with the perspective view of FIG. 7.

Arbour 6 and its axis 7 about which oscillating weight 2 rotates, is secured to plate 8 of the movement 3 outlined in FIG. 5. Weight 2 is carried by semi-circular sector 9. Peripheral zone 10 of this sector 9 is secured to weight 2 by means of screws 21. The central zone 11 of this sector 9 is secured to tube 5 by means of screws 22. Tube 5 rotates freely about arbour 6. A ball bearing 25 is arranged between arbour 6 and tube 5. The crown 26 of bearing 25 is driven inside tube 5 and the central part 27 of the same bearing 25 is fitted onto arbour 6 and held there axially between a shoulder 28 made on arbour 6 and a key 29. Tube 5 drives a wheel 30, which is secured to tube 5 by the same screws 22 used to secure sector 9 to said tube 5. FIG. 6 shows that sector 9 is sandwiched between tube 5 and wheel 30. The same Figure also shows that wheel 30 drives a first intermediate wheel set 31, which starts a chain leading to a winding ratchet. Arbour 32 of this first wheel set pivots between plate 8 and a bridge 17, which is extended by tongue 16 that limits the axial shake of weight 2, said tongue being introduced into the aforecited groove 15.

What is claimed is:

1. An oscillating weight for automatically winding a timepiece movement, wherein the oscillating weight pivots off-centre relative to a centre of the timepiece movement and is made of a single heavy material, wherein the oscillating weight is carried by a first plate acting as a shock absorber, wherein one end of the first plate is secured to the oscillating weight, and the other end of the first plate is fixed to a tube arranged to rotate about an arbour forming an axis of rotation of the oscillating weight, wherein stop means are implemented to limit an axial shake of the oscillating weight in the event of any shock, and wherein the stop means consist of a groove that is made in the oscillating weight and penetrated by a retaining tongue forming an end of a banking bridge.

2. The oscillating weight according to claim 1, wherein the first plate is arranged between the oscillating weight and at second plate of the timepiece movement.

3. The oscillating weight according to claim 1, wherein the first plate takes the form of an approximately semi-circular sector, the peripheral zone of which is secured to the oscillating weight and the central zone of which is secured to the tube, the intermediate zone of which is located between said peripheral and central zones having a resilient middle that can bend in the event of any shock applied to the oscillating weight.

4. The oscillating weight according to claim 3, wherein the intermediate zone has at least two resilient arms directed towards the axis of rotation of the oscillating weight.

* * * * *